US005799551A

United States Patent [19]

Vitrac

[11] Patent Number: 5,799,551

[45] Date of Patent: Sep. 1, 1998

[54] CORKSCREW

[75] Inventor: Jean-Pierre Vitrac, Paris, France

[73] Assignee: Impex Handelsgesellschaft Mbh (F.E.) Ltd., Hong Kong

[21] Appl. No.: 819,352

[22] Filed: Mar. 18, 1997

[51] Int. Cl.[6] ..... B67B 7/04

[52] U.S. Cl. ..... 81/3.09; 81/3.45; 81/3.15; 7/155

[58] Field of Search ..... 81/3.15, 3.09, 81/3.35, 3.36, 3.29, 3.45, 3.47, 3.48, 3.33, 3.37; 7/151, 154, 155

[56] References Cited

U.S. PATENT DOCUMENTS 2,886,994 5/1959 Hanson ..... 81/3.09 X

FOREIGN PATENT DOCUMENTS 599807 11/1959 Italy ..... 81/3.15

346449 6/1960 Sweden ..... 81/3.35

*Primary Examiner*—D. S. Meislin

*Attorney, Agent, or Firm*—Samuels, Gauthier, Stevens & Reppert

[57] ABSTRACT

A combined corkscrew and stopper comprises a central body 10 with two handles 12 and 13 pivotably mounted to the body. When the handles are closed together, the handles surround a corkscrew and remote ends 16 and 17 form a bottle stopper.

5 Claims, 3 Drawing Sheets

CORKSCREW

BACKGROUND OF THE INVENTION

1. Field of the Invention

The invention relates to corkscrews.

2. Description of Prior Art

Many bottles are closed by corks that must be removed to gain access to the contents of the bottle. If the whole of the contents are not required and must be saved for later use even much later use, say, several days after first opening the bottle, the bottle should be ideally resealed. The removed cork may be replaced, if not damaged, but it is unlikely to seal the bottle satisfactorily. Suitable replacement corks or stoppers are already known that are used to seal any bottle, as required. Such corks or stoppers must be separately purchased and stored for use as required which adds to the expense and inconvenience.

SUMMARY OF THE INVENTION

It is an object of the invention to overcome or reduce these problems.

According to the invention there is provided a combined corkscrew and bottle stopper device comprising a central body, a corkscrew anchored to the body at a first end and extending away from the body to a remote screwed end, a plurality of handles distributed around the body and each having a first handle end pivotably fixed to the body and a second handle end providing a sector of a complete cylindrical body that forms the bottle stopper when the handles are closed together, in which the handles pivotably open around the body to form manually operable levers for rotating the corkscrew and close together to embrace the corkscrew when forming the bottle stopper.

Preferably, there are two handles opposedly mounted to the body.

Each said sector may comprise a separate sleeve formed of resilient material.

The said sectors may be formed with inter-engaging locating parts that close together into engagement when the handles are closed together.

The handles may be formed with ribbing for facilitating manual gripping of the handles during rotation of the corkscrew.

The body and the handles may be formed of molded plastics material.

BRIEF DESCRIPTION OF THE DRAWINGS

A combined corkscrew and bottle stopper device according to the invention will now be described by way of example with reference to the accompanying drawings in which.

DESCRIPTION OF THE PREFERRED EMBODIMENTS

Figure 1:
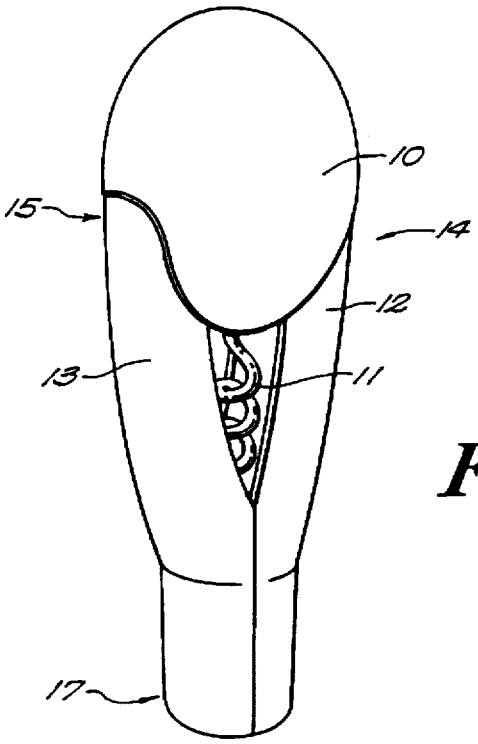
FIG. 1 is an isometric view of the device in a closed configuration.

Referring to the drawings, in FIG. 1 the device has a central body 10 to which one end of a corkscrew 11 is anchored. Two opposedly mounted handles 12 and 13 are pivotably connected to the central body 10 adjacent their first ends 14 and 15 and extend to respective second ends 16 and 17. When the device is closed the handles embrace or contain the corkscrew 11 and the ends 16 and 17 close and press together to form a bottle stopper, each end 16 and 17 being formed as a half sector of a cylinder.

Figure 2:
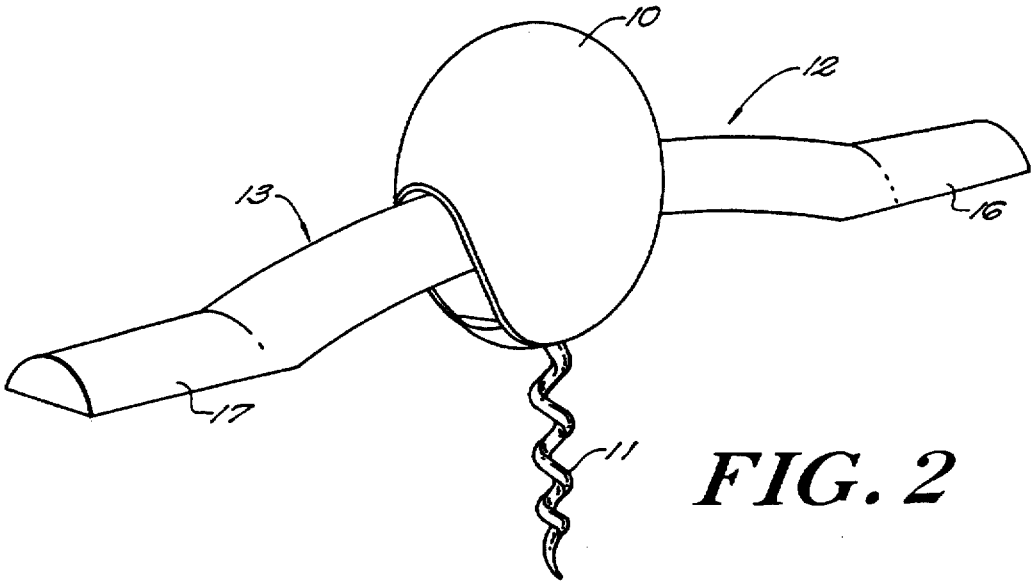
FIG. 2 is an isometric view of the device in an open configuration.

When the device is open (see FIG. 2), the handles 12 and 13 extend outwards to provide manually grippable wings to facility the turning of the corkscrew 11 into the top of a bottle in otherwise conventional fashion. The body 10 is shaped such that the handles 12 and 13 do not pivot upwards beyond the position shown in FIG. 2. This makes the open device more easier to operate manually because the handles are arrested in a maximum upward pivoting position. In practice, the upwardly restricted pivotal movement make it easier to operate the device as a corkscrew because some upward purchasing of the handles against the body 10 is used to give the handles a more stable rotational axis when manually turning the corkscrew.

Figure 3:
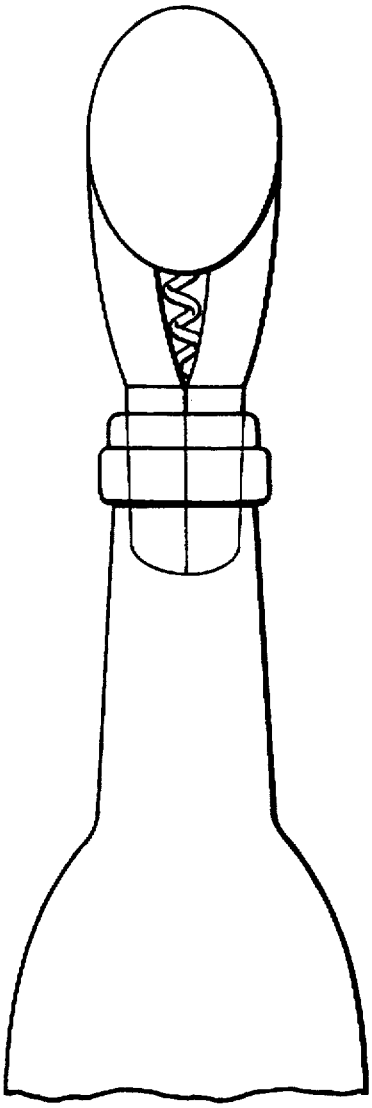
FIG. 3 shows the device fitted to a bottle top.

FIG. 3 shows the device when closed and fitted to a bottle 18. The device serves as a re-usable bottle stopper as well as a corkscrew and offers the practical advantage over the prior art where such products invariably are separate items.

Figure 4:
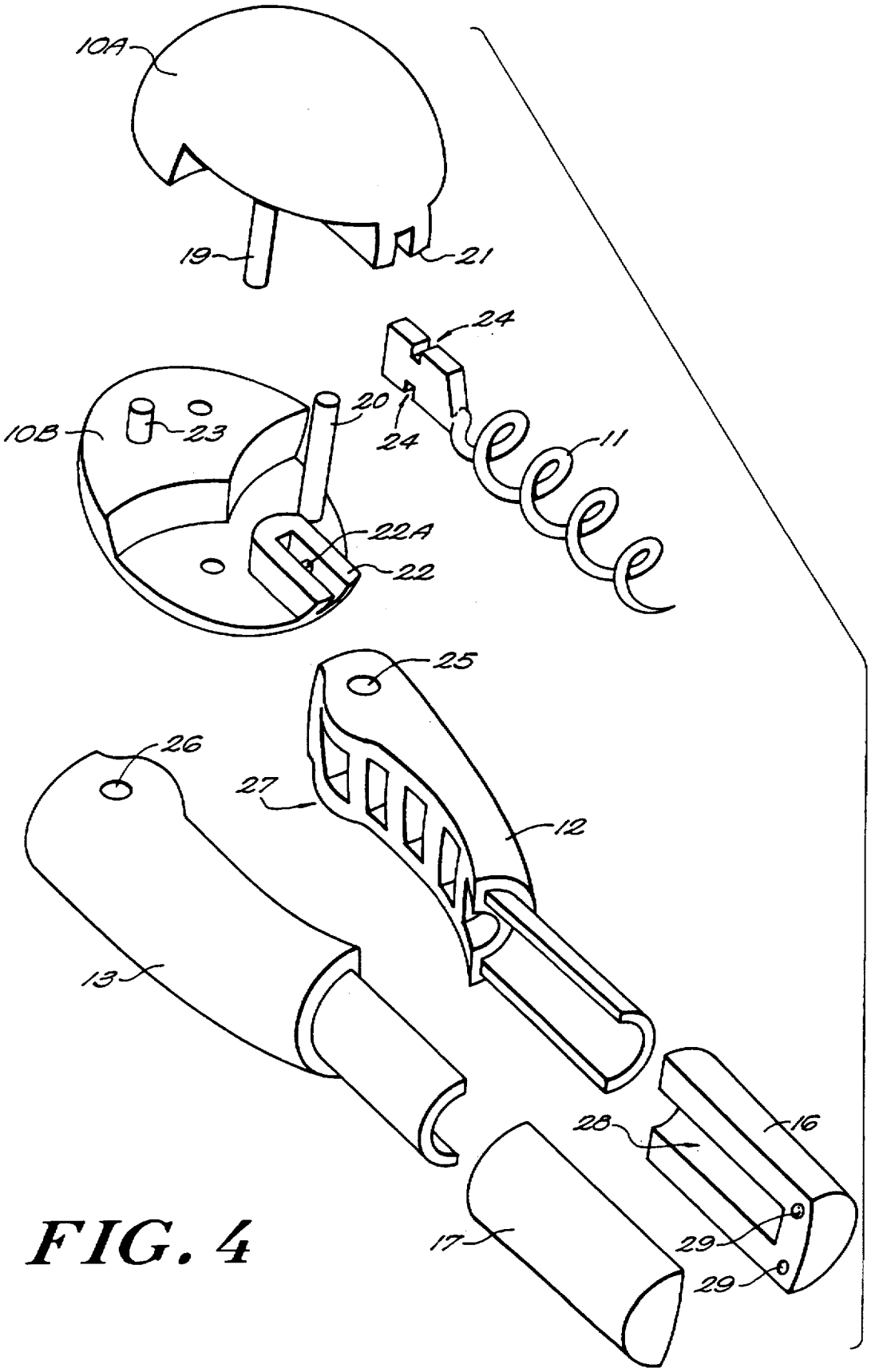
FIG. 4 is a isometric exploded view of the device.

In FIG. 4, various specific aspects of the overall design are carefully illustrated. The body 10 is formed by two identical halves 10A and 10B. It will be noted that each half is integrally molded with pivot axles 19 and 20, half corkscrew anchor brackets 21 and 22, respectively, and with identical locating pins (only locating pin 23 is visible in the Figure). The half anchor brackets 21 and 22 fit together when the body parts 10A and 10B are held together by glue (or clips or screws, not shown) and each bracket has ledges (see 22A) that enter into respective cut-outs 24 in one end of the corkscrew 11 to anchor the corkscrew to the central body 10.

Figure 5:
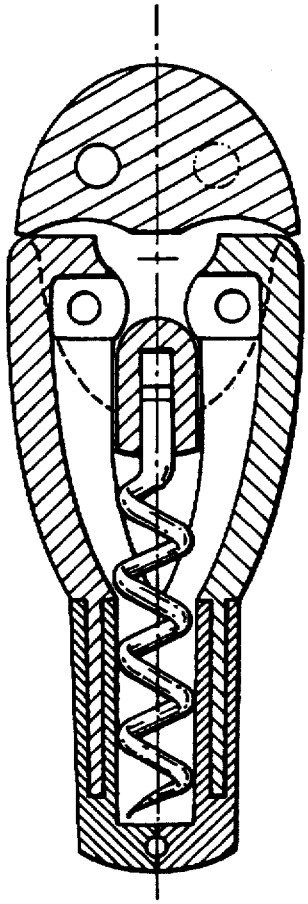
FIG. 5 shows a sectional side view of FIG. 1.

The handles each have an aperture 25 and 26 for receiving the axles 20 and 19 respectively to form the pivotable connections with the central body 10. An underside surface of each arm has ribbing 27 for facilitating manual gripping of the handles 12 and 13 during use when the device is open and rotating the corkscrew 11. The remote ends 16 and 17 are provided as semi-cylindrical replaceable sleeves made of rubber or suitable resilient plastics material. The sleeves are each formed with a half cylindrical cavity 28 to accept a remote end of the corkscrew 18 (see FIG. 5) when the handles are closed. The sleeves each have inter-engaging locating parts 29 and 30, at least adjacent their remote ends, that ensure that the sleeves while being pressed together and used as the bottle stopper, resist separation from one another when forced into the top of the bottle 18.

The described body 10 and handles are formed of molded plastics material. They may also be wholly or partly made of other materials, including non-corrosive or corrosion protected metals. Whereas the described device has two handles, embodiments of the invention can be made with three or four or possibly more handles, if preferred. In each case, the remote ends of the handles are used to form a bottle stopper when the device is closed.

It is also possible, especially when the central body parts 10A and 10B are held together by a clip or similar, to remove the corkscrew 11 and fit it to another like body. In this way, a single corkscrew 11 can be used in several such bodies. When a second bottle, for example, then needs to be opened, the first body acting as a replacement bottle stopper need not be removed. On the other hand, in embodiments of the invention, where the body parts 10A and 10B are glued or otherwise permanently fixed together, as the cost of the corkscrew itself can be relatively low a domestic user, for example, may find that it is perfectly reasonable to have three or four of the combined corkscrew and bottle stoppers to cope with normal requirements.

I claim:

1. A combined corkscrew and bottle stopper device comprising a central body, a corkscrew anchored to the body at a first end and extending away from the body to a remote screwed end, a plurality of handles distributed around the body and each having a first handle end pivotably fixed to the body and a second handle end providing a sector of a complete cylindrical body that forms the bottle stopper when the handles are closed together, such that each sector comprises a separate sleeve formed of a resilient material, and wherein the handles pivotably open around the body to form manually operable levers for rotating the corkscrew and close together to embrace the corkscrew when forming the bottle stopper.

2. A combined corkscrew and stopper according to claim 1, comprising two handles opposedly mounted to the body.

3. A combined corkscrew and stopper according to claim 1, in which the said sectors are formed with inter-engaging locating parts that close together into engagement when the handles are closed together.

4. A combined corkscrew and stopper according to claim 1, in which the handles are formed with ribbing for facilitating manual gripping of the handles during rotation of the corkscrew.

5. A combined corkscrew and stopper according to claim 1, in which the body and the handles are formed of molded plastics material.

* * * * *